US007074088B1

(12) United States Patent
Tsai

(10) Patent No.: US 7,074,088 B1
(45) Date of Patent: Jul. 11, 2006

(54) HDMI MORTISE ADAPTER

(75) Inventor: Han-Yi Tsai, Taipei Hsien (TW)

(73) Assignee: Sure-Fire Electrical Corp., Taipei Hsien (TW)

( * ) Notice: Subject to any disclaimer, the term of this patent is extended or adjusted under 35 U.S.C. 154(b) by 0 days.

(21) Appl. No.: 11/072,336

(22) Filed: Mar. 7, 2005

(51) Int. Cl.
*H01R 9/03* (2006.01)

(52) U.S. Cl. ..... 439/610

(58) Field of Classification Search ..... 439/610, 439/357, 579, 497, 607–609, 493, 578, 404, 439/83, 78, 596
See application file for complete search history.

(56) References Cited

U.S. PATENT DOCUMENTS 4,494,813 A * 1/1985 Daley et al. ..... 439/404
6,793,527 B1 * 9/2004 Noro ..... 439/579
6,796,839 B1 * 9/2004 Wu ..... 439/607
6,843,679 B1 * 1/2005 Kuo et al. ..... 439/497
6,932,646 B1 * 8/2005 Sloey ..... 439/607
6,955,565 B1 * 10/2005 Lloyd et al. ..... 439/607

* cited by examiner

*Primary Examiner*—J. F. Duverne
(74) *Attorney, Agent, or Firm*—Leong C. Lei

(57) ABSTRACT

A high definition multimedia interface (HDMI) mortise adapter includes two sets of terminals arranged in radiant and cluster blocks, a first case, a second case, separator, and a plastic member; cluster blocks and terminals being thermoset and incorporated with each other by stubs and blind holes to allow comfortable placement of the separator in between; both cases being locked to each other by means of plate disposed on the inner side and perforated frame; and retainer and inclined angular plate disposed on the side board of the first case in conjunction with the plastic member secure both sets of terminals between both cases.

2 Claims, 6 Drawing Sheets

HDMI MORTISE ADAPTER

BACKGROUND OF THE INVENTION (a) Technical Field of the Invention

The present invention is related to an HDMI mortise adapter that allows easy assembly, solid construction and reliable transmission.

(b) Description of the Prior Art

To satisfy consumer demands, Hitachi, Panasonic, Philips, Silicon Image, Sony, Thomson (RCA), and Toshiba have joined the pool to develop DVI-based high definition multimedia interface (HDMI) with a bandwidth up to 5Gbps. At present, DVI connection transmits only image information (i.e., video and synchronous signals) while HDMI provides extra function to transmit multi-channel digital audio signals disregarding the transmission and receiving are done in compression format or not. HDMI also serves to distribute the basic control data. To be more practical, the adapter used by HDMI is smaller in size than that of DVI and enhanced supports to high definition "digital device format", which is not found with DVI-HDTV. Other than that as with DVI-HDTV, HDMI also includes HDCP technology to protect contents.

The new guidepost set by HDMI is equivalent of the preparation of integrated future non-compressed digital video and multi-channel audio into a single total digital interface, one that also integrated with HDCP security mechanism to protect the access to good quality contents. It also simplifies the complicated installation of A/V cables of the current home entertainment system by replacing one HDMI cable to exit the conventional eleven A/V cables paying significant savings for the manufacturer as well as the consumer without compromising the A/V quality. This addresses the fact that each link contributing to the results of the transmission system cannot be over stressed.

The adapter disposed at the beginning point of HDMI transmission is demanded to be smaller in size than that of the DVI is very important since it affects the results of the subsequent transmission. However, the trade appears to neglect this by resolving to the design mode of the general adapter that requires tedious and annoying process and increased production cost.

SUMMARY OF THE INVENTION

The primary purpose of the present invention is to provide an HDMI mortise adapter, wherein, multiple terminals are arranged in two rows and in radiant that differ from the conventional four-row process while multiple grounding terminals are reduced into two rows.

Another purpose of the present invention is to provide an HDMI mortise adapter to minimize consonant effects due to loosening terminals. To achieve the purpose, a special design of distribution in radiant is used for terminals by direct injection of cluster blocks for thermosetting that differs from the conventional plug-in connection.

Another purpose yet of the present invention is to provide an HDMI mortise adapter to prevent mutual EMI between both rows of terminals.

Another purpose yet of the present invention is to provide an HDMI mortise adapter that secures both sets of terminals in place between a first and a second cases. To achieve the purpose, each of the first and the second cases is made integrated and locked to another by means of stubs on the side plate and frame holes. Furthermore, retainer is provided on the side plate of the first case and an angular plate inwardly inclined is disposed in front of the rectangular frame; and a protruding reinforcement plate is forged on the upper part of the first case to secure both rows of terminals at where between the first and the second cases in conjunction with the plastic plug.

The foregoing object and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

The following descriptions are of exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
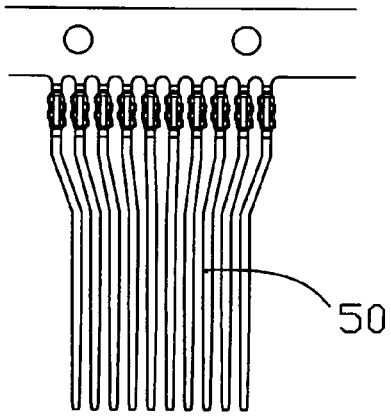
FIG. 1 is a schematic view showing multiple terminals of a preferred embodiment of the present invention.

An HDMI mortise adapter of the present invention is comprised of two sets of a first case 10, a second case, and a plastic member 30, and two rows of terminals 50*a*, 50*b*, two cluster blocks 60, 70 and a separation plate 80. Referring to FIG. 1, those terminals 50 are provided in two rows instead of conventional four rows, and are arranged in radiant to increase the space needed connection during the assembly of the adapter thus to improve reliability of mortised transmission and shortened work hours.

Figure 3:
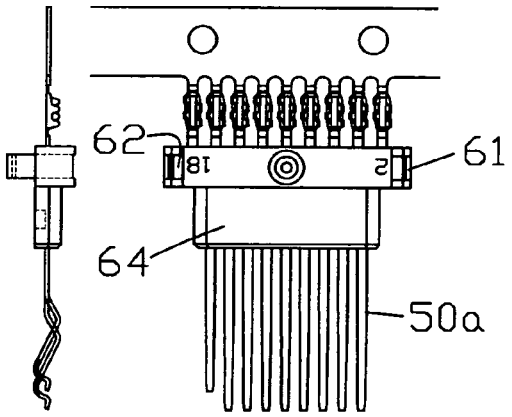
FIG. 3 is a schematic view showing an assembly of those terminals and the upper cluster of the preferred embodiment of the present invention.
Figure 2:
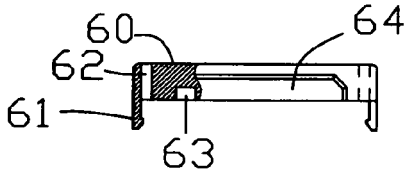
FIG. 2 is a schematic view of an upper cluster block of the preferred embodiment of the present invention.
Figure 5:
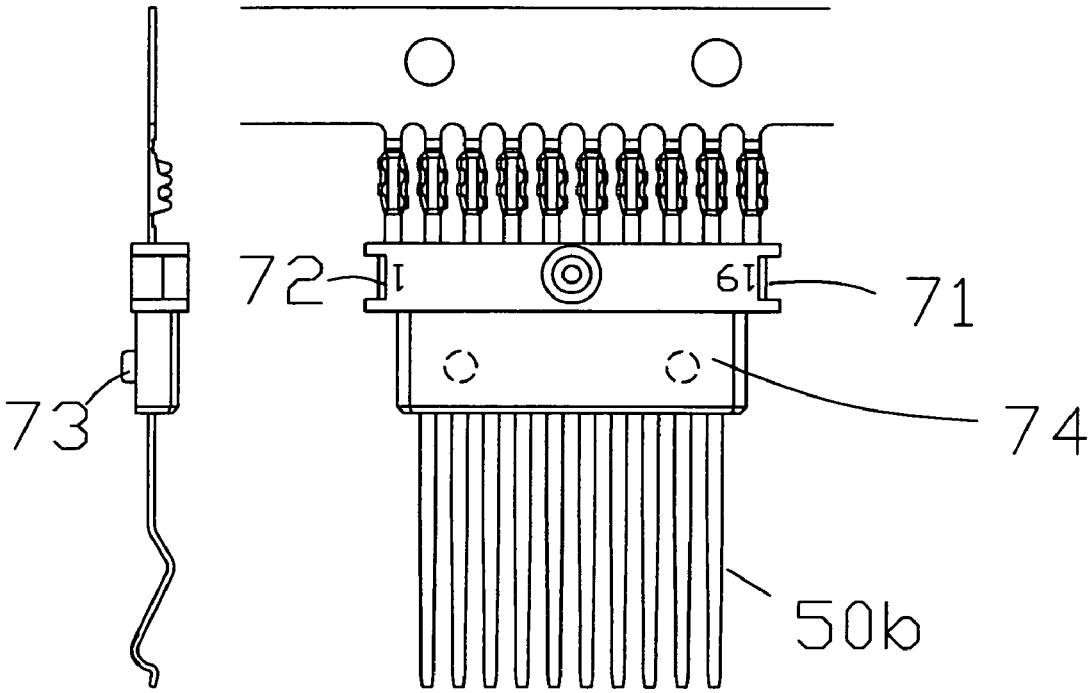
FIG. 5 is a schematic view showing an assembly of those terminals and the lower cluster of the preferred embodiment of the present invention.
Figure 4:
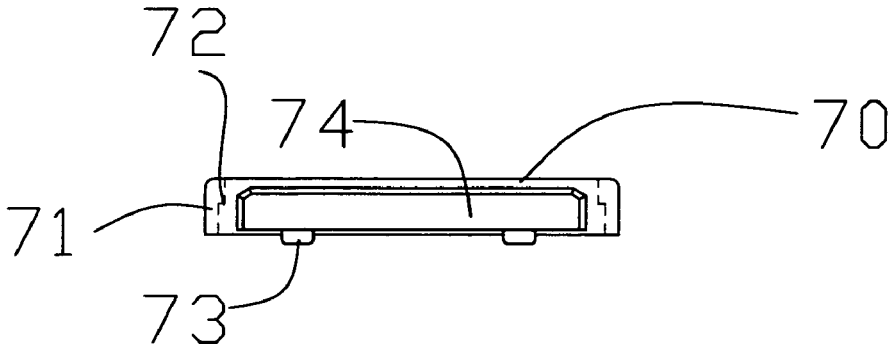
FIG. 4 is a schematic view of a lower cluster block of the preferred embodiment of the present invention.

As illustrated in FIGS. 2 and 4 for the shape of those terminals 50 thermoset with both cluster blocks 60, 70, a latching member 61 is each protruding downwardly from both ends of the upper cluster block 60, a hole 62 is disposed by the bottom of the latching member 61, and a tongue 64 is provided forwardly from the upper cluster block 60, and two blind holes 63 are disposed at where below the upper cluster block 60. Also referring to FIG. 3, the upper cluster block 60 is thermoset and integrated with the terminal set 50*a*. As illustrated in FIGS. 4 and 5, another tongue 74 is provided to the lower cluster block 70, and two stubs 73 to be respectively locked to their corresponding blind holes 63 on the upper cluster block 60. Furthermore, a recess 71 and an inner level 72 are provided at where in alignment with their corresponding latching members 61 on the upper cluster 60 to receive both stubs 73.

Figure 6A:
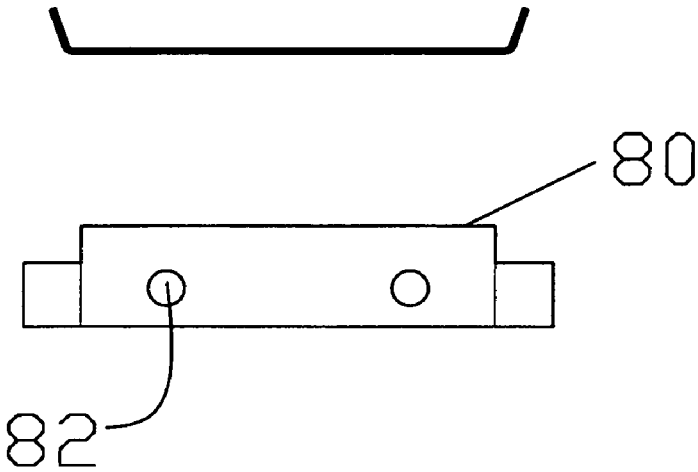
FIG. 6 is a schematic view showing a metallic separator of the preferred embodiment of the present invention.
Figure 6B:
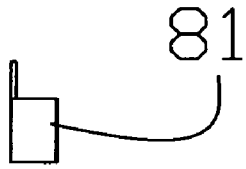

Now referring to FIGS. 6A and 6B, the metallic separation plate 80 is made roughly in the shape of ⊓but with its both side plates 81 spreading outwardly to contact the metallic cases for screening purpose. A hole 82 is provided on the lateral frame to merely receive the insertion of the stub 73 of the lower cluster block 70.

Figure 7A:
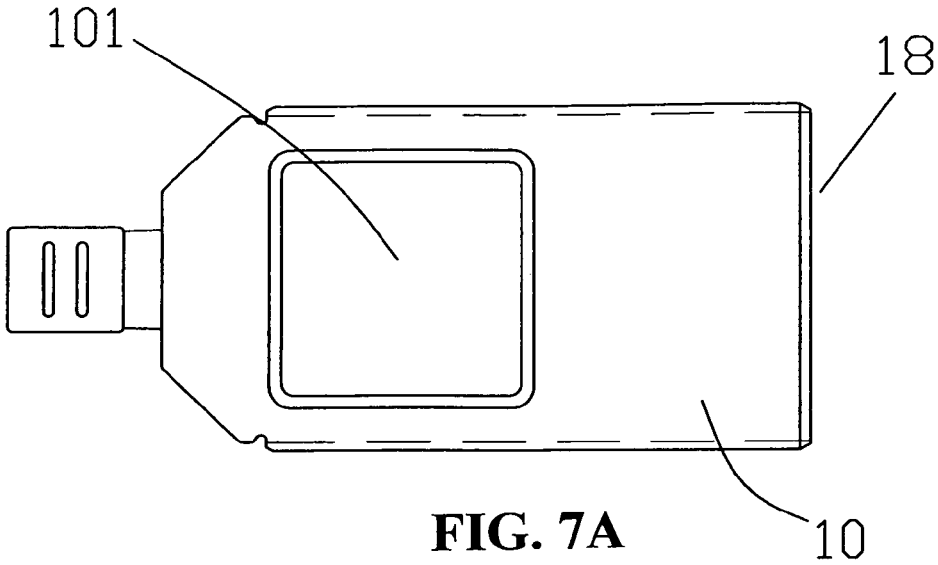
FIG. 7 is a schematic view showing a first case of the preferred embodiment of the present invention.
Figure 7B:
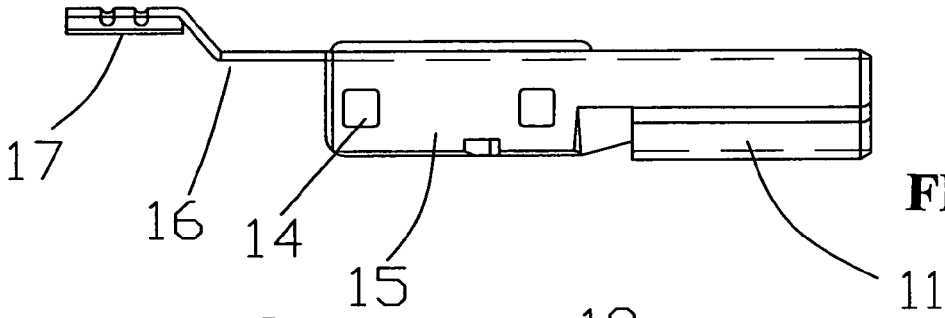
Figure 7C:
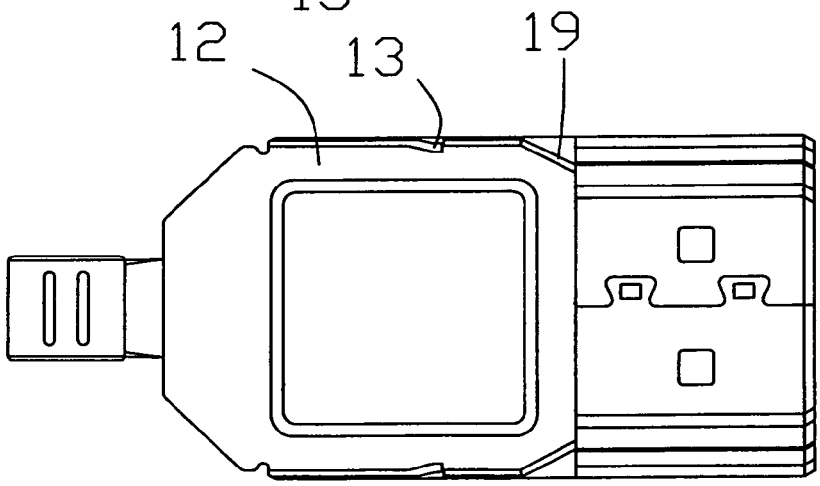

As illustrated in FIGS. 7A, 7B and 7C, the first case 10 has its front section made in a hollowed rectangular frame 11 and its rear section a ⊓shaped frame 12, and an inwardly inclined plate 19 given proper resilience is provided on a side plate 15 at where both of the frames 11, 12. Two holes 14 are provided on each of both side plates 15 and a retainer 13 inwardly protruding from the edge of the side plate 15 to accommodate the cluster in conjunction with the inwardly inclined plate 19. A neck 16 extends from the rear end of the frame 12 to connect an upper lid 17, and an angular plate 18 inwardly is provided at the front of the frame 11.

Figure 8A:
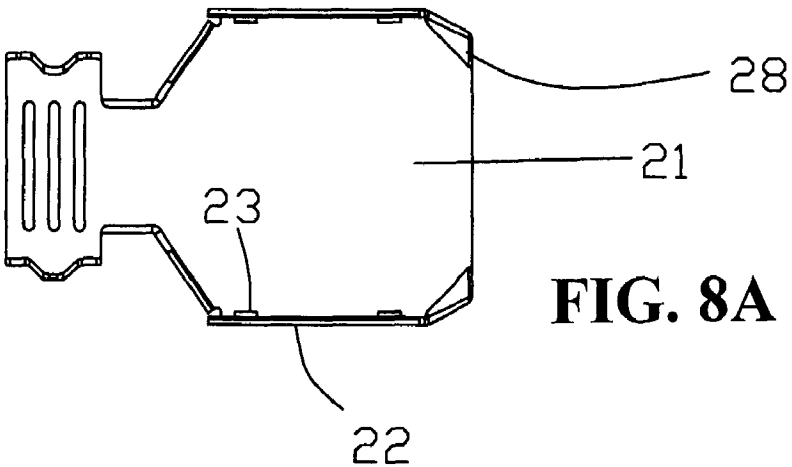
FIG. 8 is a schematic view showing a second case of the preferred embodiment of the present invention.
Figure 8B:
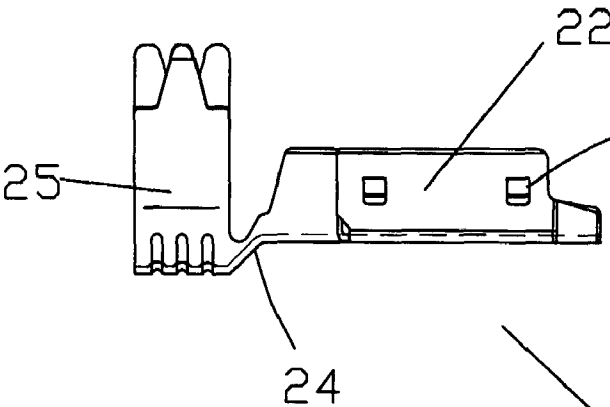
Figure 8C:
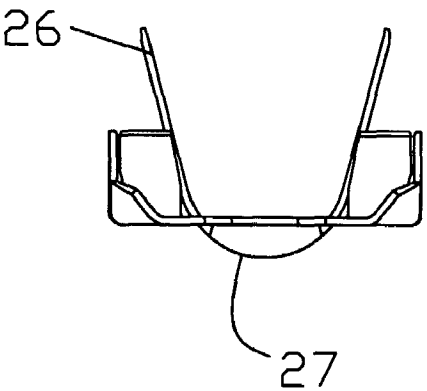

As illustrated in FIGS. 8A, 8B and 8C, the second case 20 made of metallic material related to a larger ⊓shaped frame 21 compared to that of the first case 10 and a lower lid 25 connected to each other with a neck 24. An inwardly protruded plate 23 is each provided on both side plates 22 of the frame 21 and a slope 28 inwardly inclined is each provided on both sides of the front opening of the frame 21. The lower lid 25 indicates a shape of an upward ladder and an arc plate 27 in the lower end with two wings 27 extending upwardly from both sides of the lower lid 25.

Both cases 10,20 are each made integrated and forged with a protruded reinforcement plate 101 in square as illustrated.

Figure 9A:
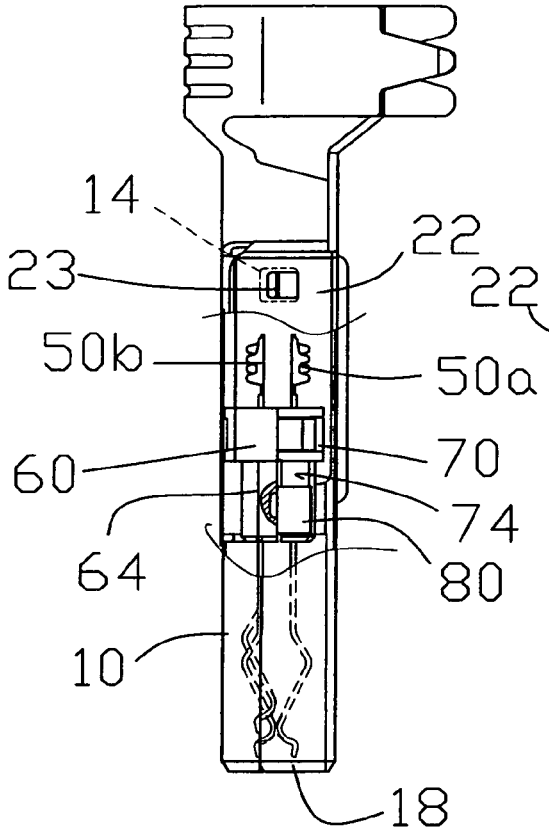
FIG. 9 is a schematic view showing the preferred embodiment of the present invention as assembled.
Figure 9B:
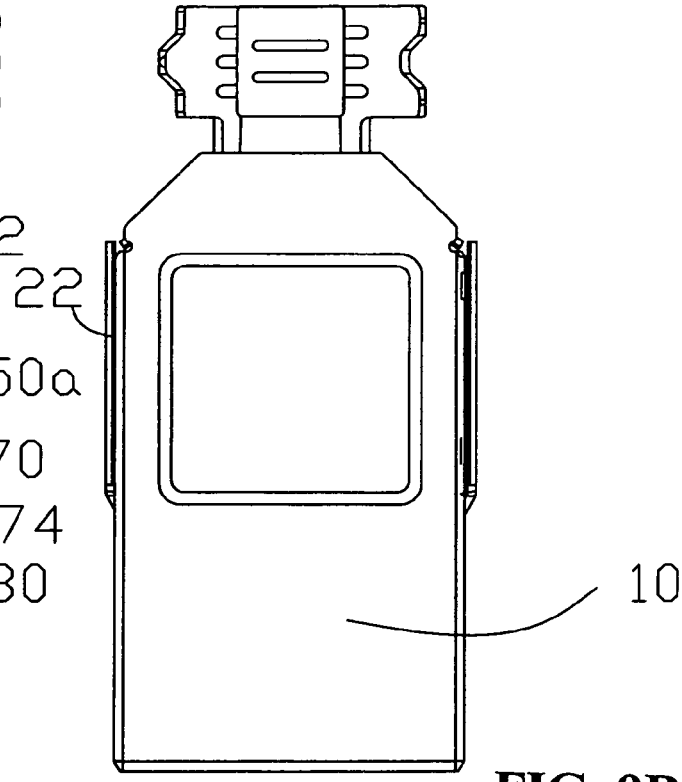
Figure 9C:
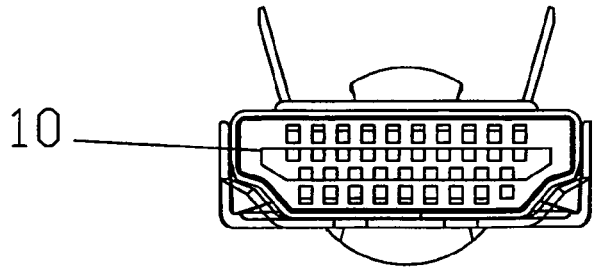

The HDMI mortise adapter allows fast and reliable assembly. As illustrated in FIGS. 9A, 9B and 9C, both cases 10,20 are assembled by locking those holes 14 of both side plates 15,22 and the inner protruded plate 23 while both rows of terminals 50*a*, 50*b* are secured at where between both cases 10, 20 by having the retainer 13 and the inwardly inclined plate 19 of the first case and the inwardly inclined plate 29 at the front end of the second case 20 to rest on both of the upper and the lower cluster blocks 60, 70. Wherein, the metallic separation plate 80 is disposed between both cluster blocks 60, 70. A plastic member 30 is provided to the front of the plug at where those multiple terminals are provided to secure the separation plate 80 while being held in place in the frame 14 as restricted by the inwardly inclined angular plate 18.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. An HDMI mortise adapter comprising;

an upper cluster having its both ends protruding downwardly a latching part, a tongue being forwardly provided, two blind holes being disposed beneath the upper cluster block, and the upper cluster block being thermoset and integrated with one row of multiple terminals;

a lower cluster block, being provided with a tongue, two stubs below to merely lock to both blind holes of the upper cluster block; a recess and an inner ladder being disposed at where in relation to the latching part of the upper cluster block to be locked into the upper cluster block, and being thermoset and integrated with another row of multiple terminals;

a metallic separation plate, roughly in an inverted U-shape with two side plates spreading outwardly, and a hole being provided on the lateral frame;

a first case having its front section made a hollowed rectangular frame, its rear section made in an inverted U-shaped frame, an inwardly inclined plate being disposed at where both frames meet, two holes being disposed on each of both side plates, a retainer inwardly protruding from the edge and a neck being provided in the rear end to connect an upper lid, and an angular plate inwardly inclined being provided at the front opening of the rectangular frame; and a second case having a larger inverted U-shaped frame and a lower lid than that of the first case, the frame and the lower lid being connected to each other with a neck, an inwardly protruded plate being provided each on both side plates of the frame, and an inwardly inclined slope being each disposed on both sides at where the front opening of the frame is located, characterized by that:

both of the fist and the second cases being assembled by locking holes and inwardly protruded plates; both of the upper and the lower cluster blocks being placed on the inverted-shaped frame of the first case and secured by being subject to the restriction by the retainer and the inwardly inclined plate of the first case; the metallic separation plate being located at where between two cluster blocks and secured in place by holes and stubs; and each set of multiple terminals being secured in place by a plastic member disposed in front of the plug at where the rectangular frame is located by being subject to the restriction by the inwardly inclined angular plate.

2. The HDMI mortise adapter of claim 1, wherein both side plates of the metallic separation plate spread outwardly to contact both metallic cases.

* * * * *